United States Patent [19]

Shea, Jr.

[11] Patent Number: 4,691,489

[45] Date of Patent: Sep. 8, 1987

[54] JOINT SEAL ASSEMBLY

[76] Inventor: John R. Shea, Jr., 6404 Murray Hill Rd., Baltimore, Md. 21212

[21] Appl. No.: 828,333

[22] Filed: Feb. 11, 1986

[51] Int. Cl.[4] ..... E04H 1/00

[52] U.S. Cl. ..... 52/235; 52/208; 52/398

[58] Field of Search ..... 52/235, 398, 403, 400, 52/208

[56] References Cited

U.S. PATENT DOCUMENTS

| | | | |
|---|---|---|---|
| 3,866,374 | 2/1975 | Dallen | 52/398 X |
| 3,881,290 | 5/1975 | Bouchey | 52/398 |
| 3,968,608 | 7/1976 | Swango | 52/403 X |
| 4,092,812 | 6/1978 | Dashner et al. | 52/297 X |
| 4,464,874 | 8/1984 | Shea, Jr. et al. | 52/304 X |
| 4,543,755 | 10/1985 | Crandell | 52/235 |

FOREIGN PATENT DOCUMENTS

| | | | |
|---|---|---|---|
| 678685 | 1/1964 | Canada | 52/403 |
| 2313538 | 12/1976 | France | 52/398 |

*Primary Examiner*—William F. Pate, III
*Assistant Examiner*—R. Chilcot
*Attorney, Agent, or Firm*—Finnegan, Henderson, Farabow, Garrett & Dunner

[57] ABSTRACT

An assembly for sealing the space between adjacent architectural panel assemblies, such as window panels, includes a sealing means configured to fit between the opposing end surfaces of adjacent window panels, compressible members for engaging the sealing member and the opposing surface of each window panel, and a rigid member configured to fit in an interior cavity of the sealing member. The rigid member maintains the means in alignment with the opposing edge surfaces of the adjacent panels.

18 Claims, 10 Drawing Figures

Fig. 3
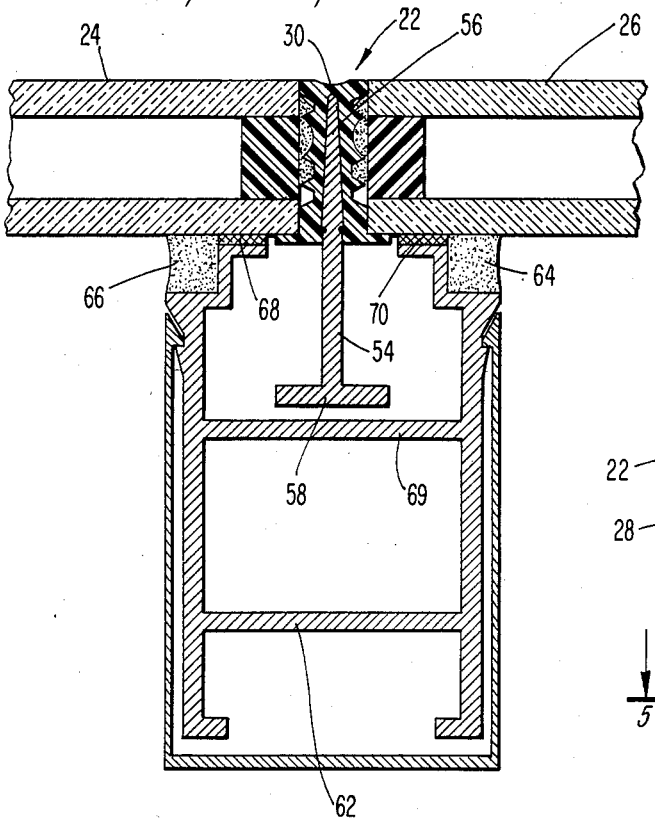
Fig. 4
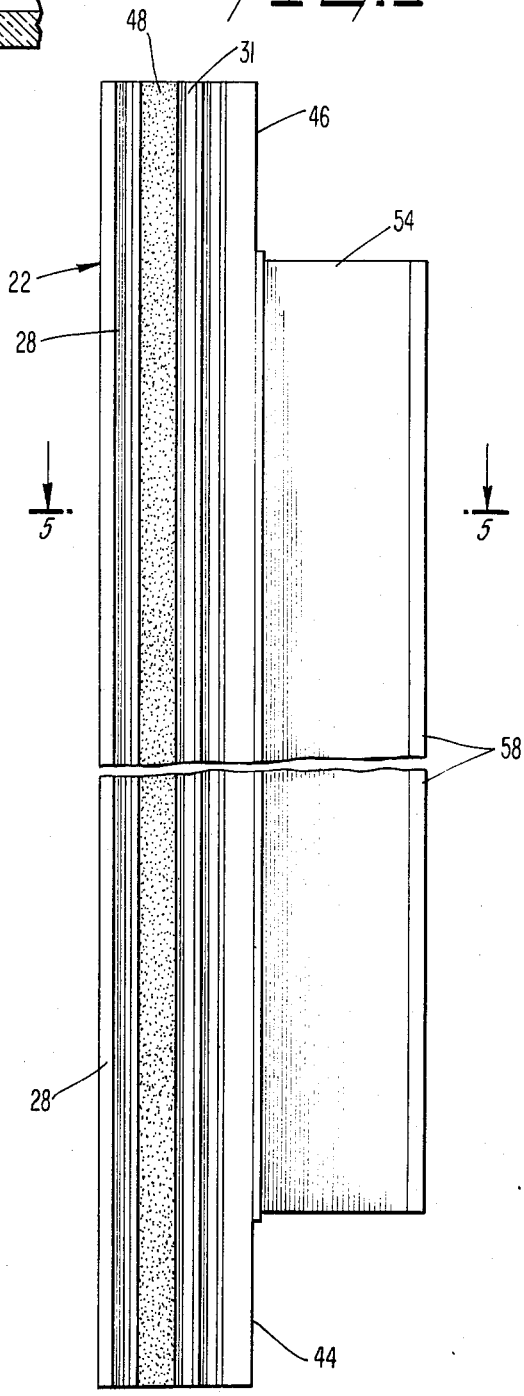
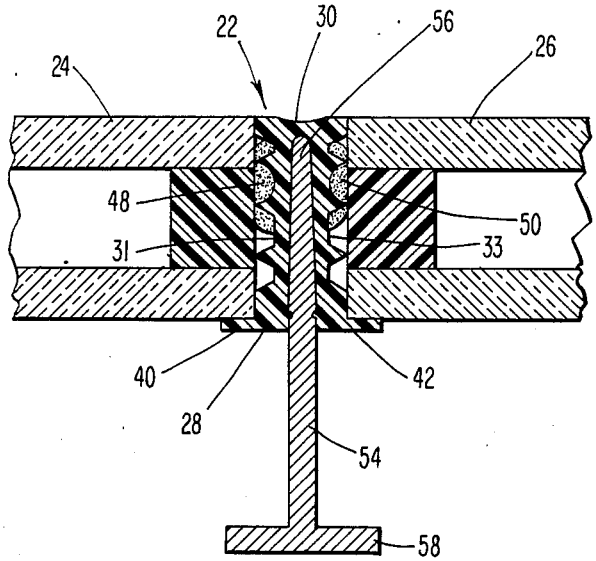
Fig. 5

22
30
56
63
28
46
26
61
24
42
54
40
9
58
9
26
24
44

JOINT SEAL ASSEMBLY

BACKGROUND OF THE INVENTION

1. Field of the Invention

The present invention relates to joint seals; and more particularly to a joint seal for sealing the space between adjacent architectural panels, such as window panels.

2. Description of the Related Art

In building design, it is often the architect's intention to incorporate an exterior window system that provides horizontal bands of windows with a minimum of apparent lines at the vertical joints between individual window panels so as to give the visual effect of an unbroken band of glass when viewed from the outside during daylight. This effect is heightened by using dark tinted glass or light reflecting glass.

With such systems, field labor constitutes a large part of the total window installation costs. Horizontal band or ribbon windows in widespread use are designed to be installed at least partially from outside of the building. When such windows are installed, temporary exterior fastener clips must be first manually inserted into the joints between individual window panels to support the window panels while interior window structural supporting adhesives cure. Once the interior window supporting adhesives are properly cured, the exterior temporary fasteners are manually removed and a sealing caulk is applied flush with the outside window panel surfaces along the exterior vertical spaces found at each window panel joint.

One such window joint assembly is illustrated in FIG. 1 and is referred to generally as 10. According to this prior art system, temporary glass retainer clips 11 are installed along the joints between individual window panels 12 and 13 when the window panels are initially set in place. A silicon adhesive 14 is then applied between each of the interior faces of the adjoining window panels and a window support member 15. The exterior temporary glass retainer clips 11 remains in place for a one to three week period during which time the silicon adhesive 14 undergoes a curing process. After the silicon adhesive 14 is fully cured, the external temporary glass retainer clips 11 are manually removed from the outside of each window joint and a polyurethane rod 16 is inserted into the opened vertical space. Next, a silicone caulk 17 is applied from the building exterior to fill in the remainder of each joint space flush with the window panel exteriors. Because the caulk 17 is manually applied to each joint, a uniform, pleasing external appearance is difficult to achieve. Once the interior silicon adhesive 14 is completely cured and the exterior silicon caulk 17 has been applied to the vertical window joint spaces to give the exterior of the band of windows an unbroken appearance, the window installation process is complete.

Although this window installation system achieves the desired effect of a continuous horizontal window band without obvious vertical joints, the installation process is extremely time consuming and labor intensive. For each joint between adjoining window panels, the temporary clips 11 may have to be applied from the exterior of the building to which glass is being applied, the polyurethane rod 16 must be inserted into the joint space from the building exterior one to three weeks after the clips 11 are applied, and the silicon caulk 17 must then be manually applied from the building exterior along the outside length of each joint between window panels.

Moreover, if a window installed as part of this type of system should break and have to be replaced, the broken window and the replacement window would have to be respectively removed and installed at least in part from the outside of the building in the same manner that the original window panel was installed and secured.

Window joint seals that do not require exterior installation are known for use in window systems that have specially formed window panels. One such window unit joint is disclosed in U.S. Pat. No. 4,464,874 to Shea, Jr. et al. wherein adjoining individual window panels are joined by compressing gasket members attached to the vertical edges of adjoining window panels. However, this window system arrangement may not be used in conjunction with standard manufactured insulating glass panels as it relies on a heavy spacer used in a minimum two-inch air space to provide support against wind load and to hold the edge seal gaskets. Further, this system requires an additional labor intensive manual caulking of the inside of each joint to provide an air seal.

SUMMARY OF THE INVENTION

Accordingly, it is an object of the invention to provide a joint seal that may be used in conjunction with architectural panels, such as window panels of any standard thickness and that may be completely installed from within the structure to which the panels are being applied.

It is another object of the present invention to provide a window joint seal for use in a window system in which replacement window panels may be replaced from within the building without disturbing surrounding window panels.

A further object of the present invention is to provide a window joint seal in which the vertical spaces between individual window panels are uniform in width from top to bottom.

Additional objects and advantages of the present invention will be set forth in part in the description that follows and in part will be obvious from the description or may be learned by practice of the invention. The objects and advantages of the invention may be realized and obtained by the apparatus particularly pointed out in the appended claims.

To achieve the objects and in accordance with the purpose of the invention, as embodied and as broadly described herein, a joint seal assembly for sealing the space between adjacent architectural panels having opposing edge surfaces is provided. The assembly comprises a flexible and compressible sealing means configured to seal the space between the opposing edge surfaces of two adjacent panels when the panels are in place. The sealing member has an elongated interior cavity that extends substantially parallel to the opposing edge surfaces. A rigid member configured to fit in the interior cavity portion of the sealing means maintains the sealing means in alignment with the opposing edge surfaces of the adjacent panels.

The accompanying drawings, which are incorporated in and constitute a part of this specification, illustrate presently preferred embodiments of the invention and, together with a description, serve to explain the principles of the invention.

BRIEF DESCRIPTION OF THE DRAWINGS

FIG. 3 is a cross-sectional view taken along the line 3—3 of FIG. 2.

FIG. 4 is a side view of the joint seal assembly according to the present invention.

FIG. 5 is a cross-sectional view taken along the line 5—5 of FIG. 4.

DESCRIPTION OF THE PREFERRED EMBODIMENT

Figure 1:
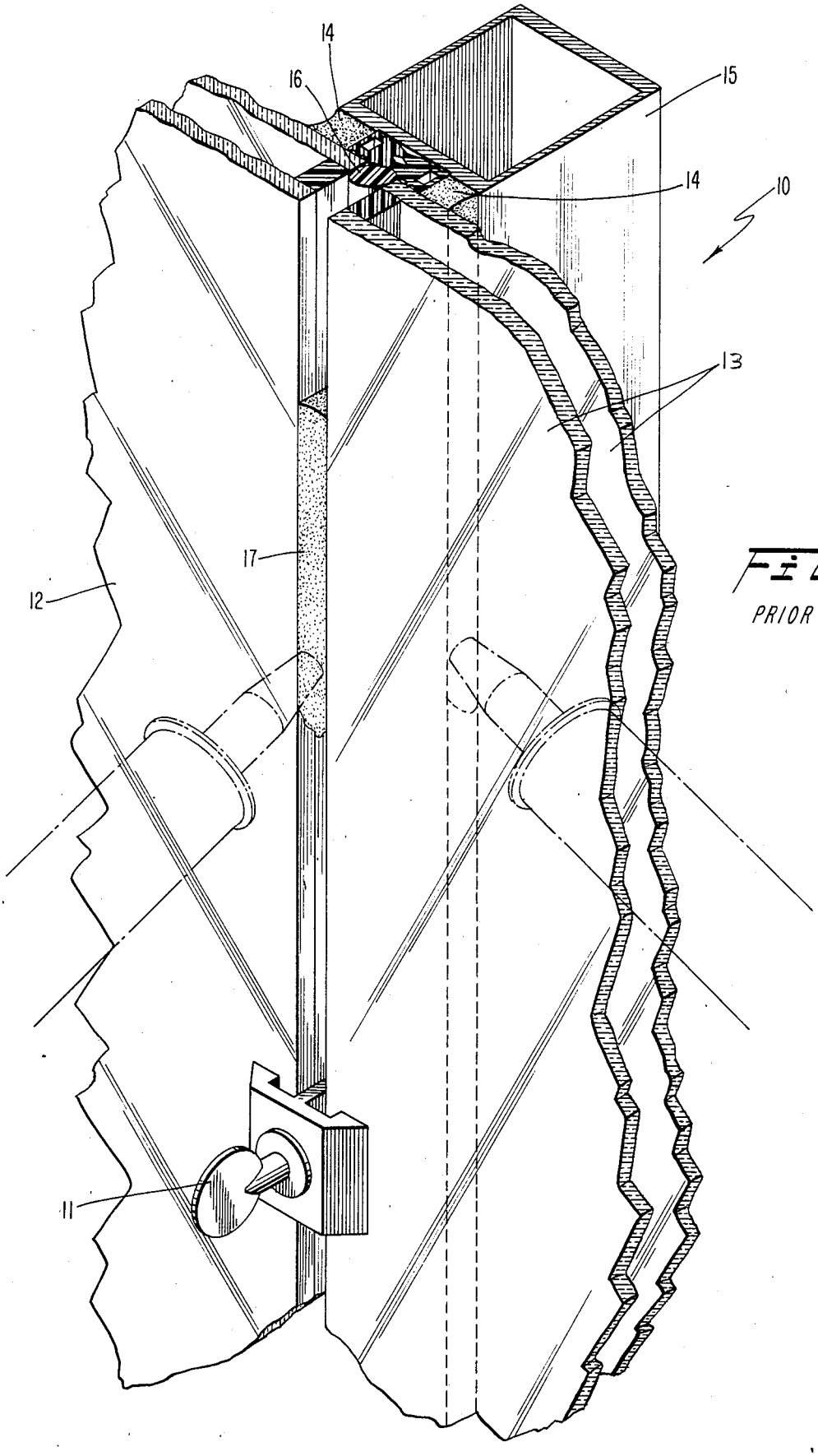
FIG. 1 PRIOR ART
FIG. 1 is a perspective view of a window joint assembly joining two window panels according to a prior art window joint system. The lower section shows the window assembly during an early stage of installation and the upper section shows an exterior silicone caulk being applied to the same joint during a later stage in the installation.

Reference will now be made in detail to a presently preferred embodiment of the invention, an example of which is illustrated in the accompanying drawings. Throughout the drawings, like reference characters are used to designate like elements.

Figure 2:
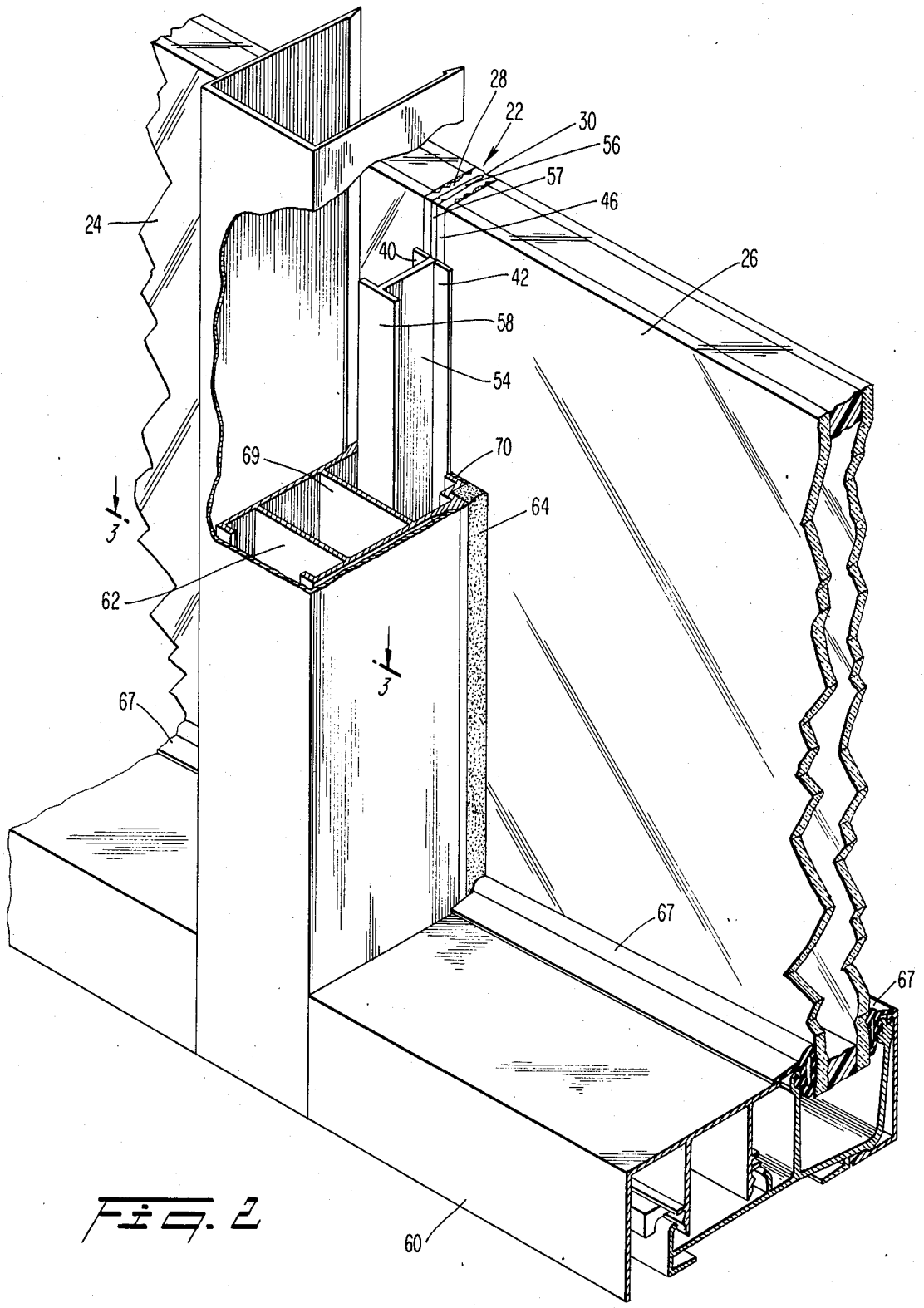
FIG. 2 is a perspective view of a window panel assembly in accordance with the present invention in which an upper portion of a vertical mullion has been cut away to expose a joint seal assembly.

A panel assembly including a joint seal assembly is illustrated in FIGS. 2 and 3. Architectural panels 24, 26, preferably comprised of standard single or multiple pane glass panels, are supported by a lower track 60 and an identical upper track (not shown). The panels 24, 26 are further supported, especially against flexing that might be caused by negative or positive wind load pressures, by a vertical supporting mullion 62. The vertical support mullion 62 attaches to the panels by two strips of structural silicon adhesive 64, 66. With the above system, two double face tape strips 68, 70 (FIG. 3), initially hold the panels against the vertical support mullion while the silicon strips 64, 66 properly cure, thus normally preventing undue stress from damaging the partially cured silicone. The joint seal assembly 22 seals the space between the panels 24, 26.

In FIGS. 4 and 5, a joint seal assembly 22, according to this invention, is illustrated. The joint seal assembly 22 is positioned between the opposing edge surfaces of two architectural panels 24, 26, preferably single or multiple glass pane window panels.

Figure 6:
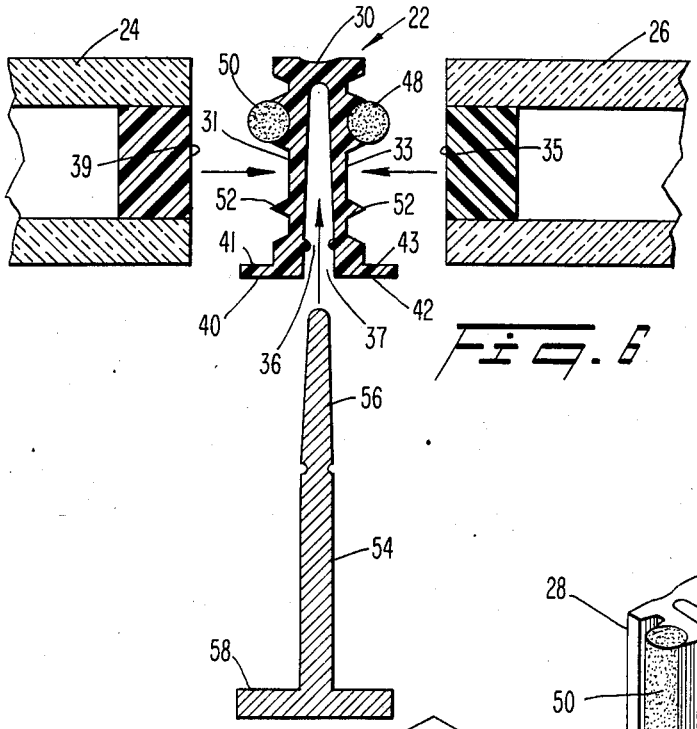
FIG. 6 is an exploded cross-sectional view of the sealing member of FIG. 5 before inserting the metal spine.

According to the present invention, a flexible and compressible sealing means configured to fit in the space between the opposing edge surfaces of two adjacent window panels when the panels are in place is provided. As embodied herein, sealing member 28 has an elongated interior cavity portion 36 extending substantially parallel to the opposing edge surfaces, as illustrated in FIG. 6. The sealing member 28 extends the vertical length of the opposing edge surfaces of the window panels 24, 26 being joined. The sealing member 28 has a horizontal cross section, as illustrated in FIGS. 5 and 6, that is U-shaped with a concave crown 30 and two spaced legs 31, 33 extending therefrom. The sealing member 28 is preferably comprised of a plastic such as silicone.

The two spaced legs 31, 33 form a slotted cavity that is tapered in the direction of the crown and extends the vertical length of the sealing member. The interior slotted cavity portion 36, is shown best in FIG. 6. The ends of the two legs, opposite the crown, define an opening 37 which is substantially parallel to the opposing edge surfaces and which extends the vertical length of the slotted cavity. Outer surface serrations 52 are formed on the outwardly facing surfaces of the spaced legs 31, 33 to face the opposing edge surfaces of the window panels 24, 26. The width of the crown 30 is slightly larger than the width of the serrated portion of the sealing member 28 to insure a firm seal between the exterior surfaces of the window panels 24, 26 and the crown 30.

Figure 7:
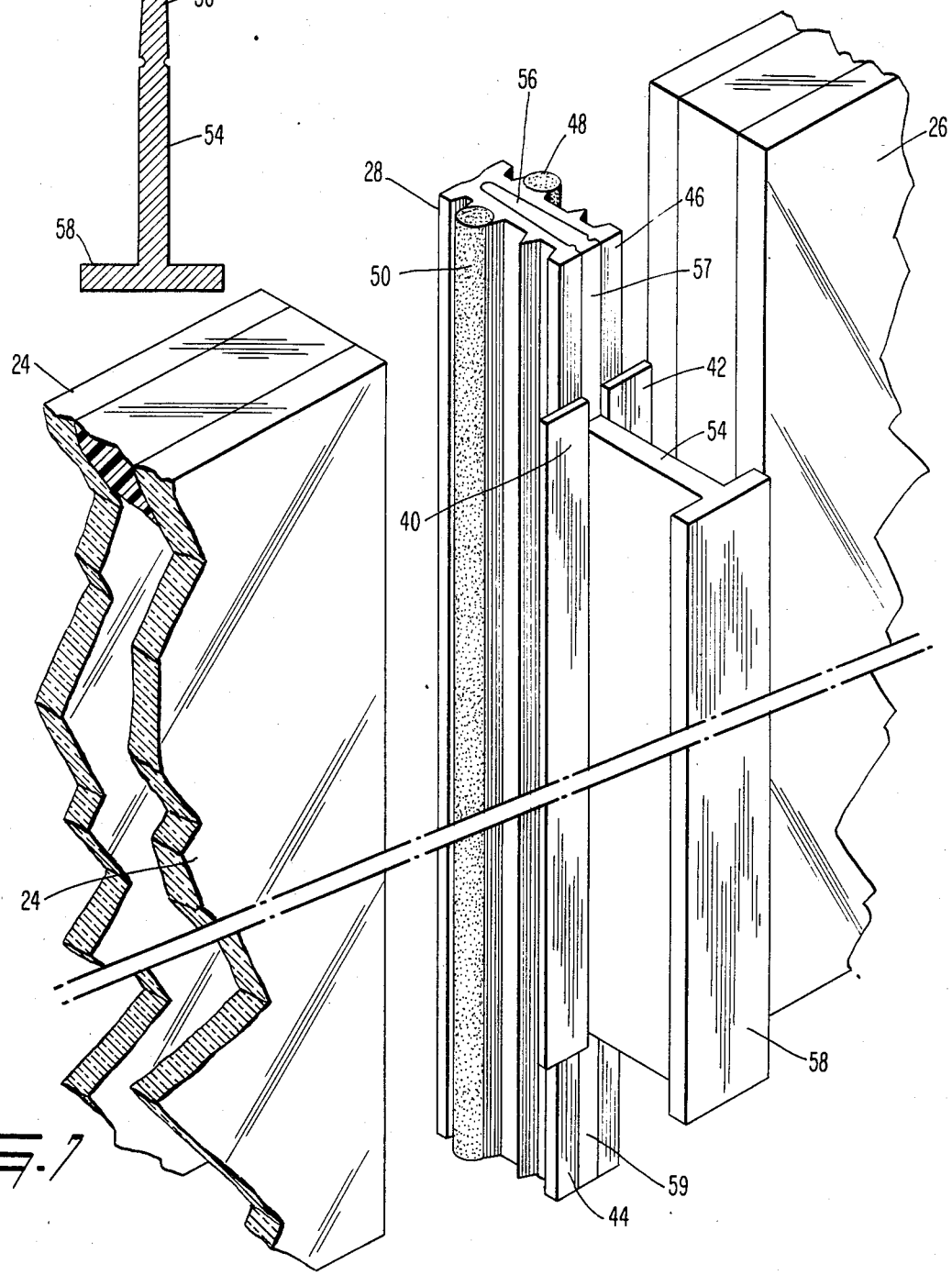
FIG. 7 is an exploded fragmentary view in perspective of a joint seal assembly according to the present invention.

The ends of the two spaced legs 31, 33 opposite the concave crown 30, are flanged outwardly away from the opening 37. The flanged portions 40, 42 have inner flange surfaces 41, 43 that face toward the crown end of the sealing member 28. As illustrated in FIG. 7, the flanged portions 40, 42, do not run the entire vertical length of the sealing member, but instead run from a short distance above the bottom 44 of the sealing member to a short distance below the top 46 of the sealing member. The dimension of each of the sealing member spaced legs from the crown 30 to the respective inner flange surfaces 41, 43 equals the width of the panels being joined such that when the flanged inner surfaces 41, 43 contact the interior surfaces of the framed window panels 24, 26, the concave crown 30 of the sealing member is aligned flush with the outside surfaces of the framed window panels 24, 26. The flanged portions 40, 42 are integral with the sealing member 28. The flanged inner surfaces 41, 42 contact with the interior edge surfaces of the window panels 24, 26 to prevent the crown 30 from projecting out beyond a position flush with the outer plane of panels 24, 26.

Figure 8:
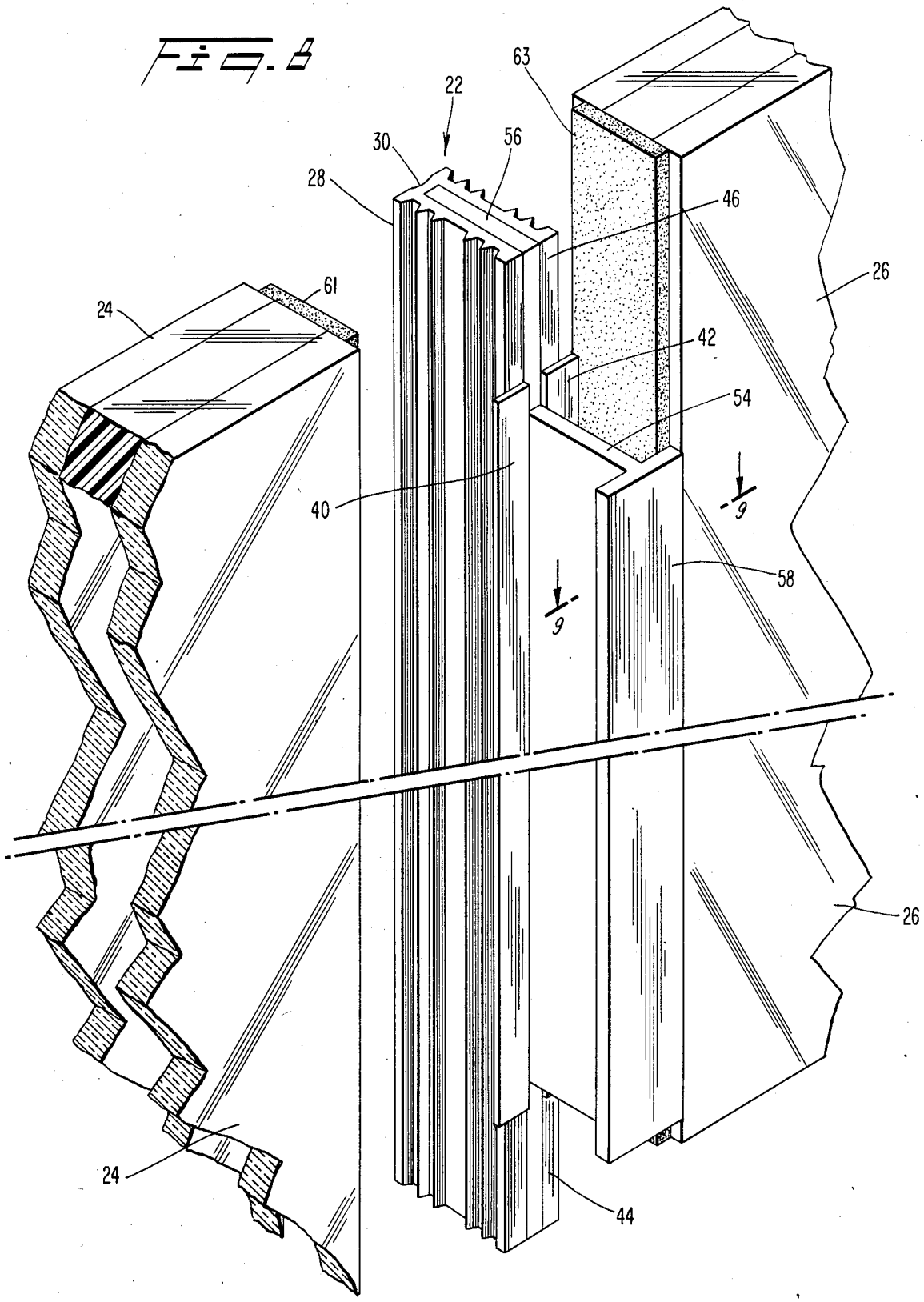
FIG. 8 is an exploded fragmentary view in perspective of a joint seal assembly according to a second embodiment of the present invention.
Figure 9:
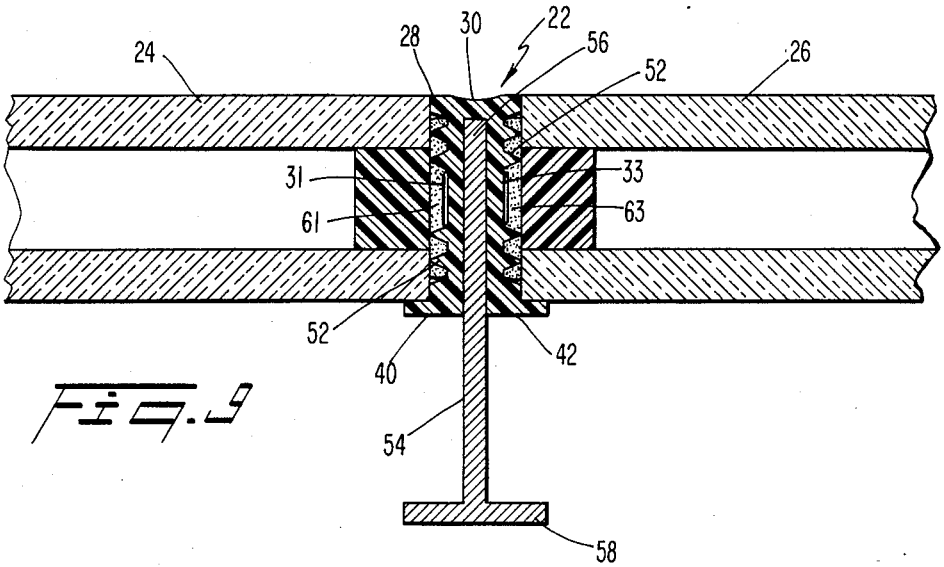
FIG. 9 is a cross sectional view taken along line 9—9 of FIG. 8.
Figure 10:
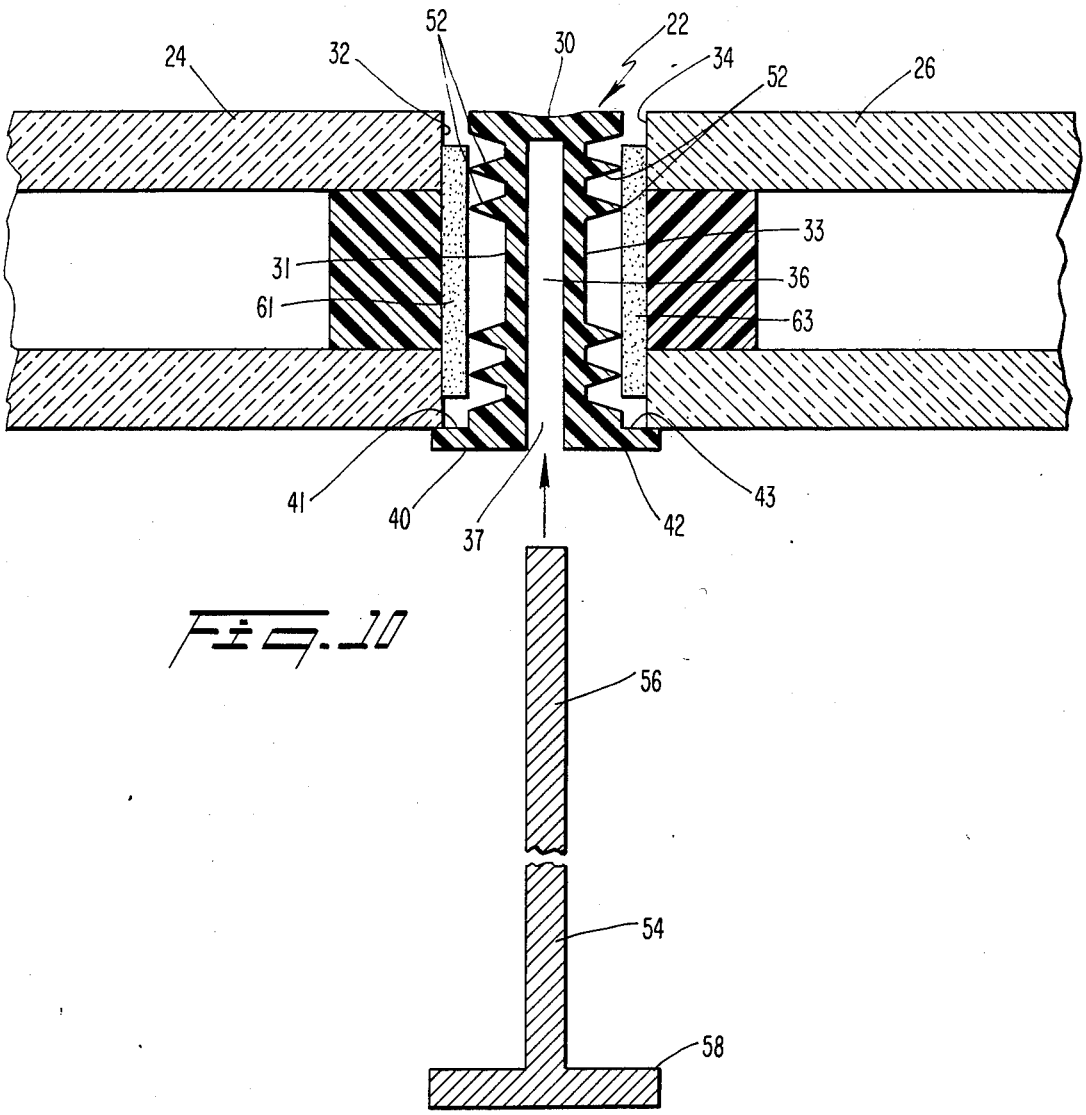
FIG. 10 is an exploded cross-sectional view of the sealing member of FIG. 9 before inserting the metal spine.

According to the present invention compressible members for engaging the sealing member serrations and the opposite edge surfaces of each of the adjacent panels are provided. As embodied herein, a first and a second strip of soft mastic sealant 48, 50 are fixed to the outer surface serrations of the sealing member. As illustrated in FIGS. 4–7, the first and second sealant strips 48, 50 face the adjacent edge surfaces 35, 39 of the two adjacent panels 24, 26. In another embodiment of the invention, as illustrated in FIGS. 8–10, a first and a second strip of soft mastic sealant 61, 63 are fixed to the opposing edge surfaces of the two window panels 24, 26. The sealant strips are for contacting the outer surface serrations 52 of the sealing member 28 and the opposing edge surfaces 35, 39. As embodied herein, the sealant strips 48, 50 and 61, 63 run vertically for the entire vertical length of the two window panels 24, 26 being joined. The soft mastic sealant may be comprised of a butyl or any material that permanently adheres to both glass and silicone and is compatible with the materials in the window assembly.

According to the present invention, a rigid member configured to fit in the interior cavity portion 36 of the sealing member 28 is provided. The rigid member maintains the sealing member 28 in alignment with the opposing edge surfaces of the adjacent panels. As embodied herein, the rigid member comprises a metal spine 54 with a T-shaped cross section. The T-shape provides the spine 54 with the necessary rigidity for holding the sealing member in straight alignment with the substantially parallel opposing edge surfaces of the two adjacent panels. As illustrated in FIG. 5, the cross section of the metal spine 54 includes an extended portion 56 and an integral cross portion 58. The extended portion 56 is dimensioned and tapered to conform to the taper of the cavity 36. As illustrated in FIG. 5, the insertion portion 56 of the metal spine fills the slotted cavity 36 of the sealing member 28. Preferably the spine 54 is comprised of an extrusion of an aluminum material. Such an extrusion will normally remain straight with narrow tolerances.

The extended portion 56 of the metal spine is of such dimension that when it is positioned and fit in the cavity 36, the spine 54 extends inwardly from the interior surfaces of the two adjacent panels 24, 26 to position the spine cross portion 58 a predetermined distance therefrom. As illustrated in FIG. 7, the extended portion 56 of the metal spine extends inwardly from the interior surfaces of the two adjacent panels 24, 26 only along the flanged portions 40, 42 of the sealing member 28. That is, the extended portion 56 of the T-shaped spine is dimensional such that when it is fully inserted in the cavity 36, the upper and lower extended portions 57, 59 of the extended portions have a depth substantially corresponding to the depth of the cavity-36. The spine extends inward from the inside of the sealing member 28 only from a short distance (approximately 2 inches) above the bottom 44 of the sealing member to a short distance (approximately 2 inches) below the top 46 of the sealing member. These spaces are provided so as to not interfere with a bottom horizontal gasket 67 (FIG. 2) and a top horizontal gasket (not shown) that respectively run along the lower track 60 and an upper track (not shown) that respectively support the upper and lower edges of the window panels 24, 26. The gasket members substantially cover the upper and lower spine portions 57, 59 in the cavity 36. The gaskets contact the spine 54 to hold it within the cavity 36.

The joint seal assembly described above may be formed in any size so as to be used in conjunction with architectural panels of various panel constructions, sizes and thicknesses.

The joint seal assembly described above is part of a window assembly that also includes the vertical support mullion 62 adjacent to the interior surfaces of the window panels 24, 26. The interior surfaces of the panels are attached to the mullion 62 by two strips of structural silicone 64, 66. The interior surfaces of the panels are further attached to the vertical support mullion 62 by two strips of double face tape 68, 70 which initially hold the panels against the vertical support mullion while the silicone strips 64, 66 properly cure.

The window assembly additionally includes a lower horizontal track 60 for supporting each of the panels 24, 26 at its bottom edge and an upper horizontal track (not shown) for supporting each of the panels 24, 26 at its top edge. The upper and lower tracks may be mounted on the structure of a building to which glass is being applied. The horizontal tracks and the vertical mullion cooperate to rigidly support the adjacent window panels.

The metal spine 54 and the vertical support mullion 62 cooperate to provide the adjacent panels with further support against undue flexing or bowing. The vertical support mullion 62 has a vertical face 69 positioned inwardly of the cross portion 58 of the rigid member 54. The vertical face 69 extends substantially the vertical length of the sealing member 28 and is located a distance from the inwardly extending face of the cross portion 58 that is less than the maximum design allowable outward bowing for the adjacent panels. When the adjacent panels 24, 26 bow outward by an amount greater than the design allowable, the mullion vertical face 69, which bows with the vertical mullion 62 and the attached panels 24, 26, contacts the rigid spine 54 which may not bow with the panels. The rigid spine 54, which is held in the sealing member cavity 36 only at top and bottom of the spine, remains straight. Once the vertical mullion face 69 bows enough to contact the rigid spine, the spine 54 combines with the vertical mullion 62 to make further bowing of the adjacent window panels 24, 26 more difficult.

The window assembly according to the invention, can be orignally installed from within the building to which glass is being applied. Further, when replacement of a glass panel is required, the replacement panel may be installed and sealed with joint seal assemblies according to the present invention from completely within the building to which the replacement glass is being applied. When the joint seal assembly of this invention is used to seal all of the vertical joints between window panels, vertical spaces between window panels will appear uniform. It is to be understood that the described embodiment is merely exempliary and that other joint seal configurations and arrangements may be employed without departing from the spirit or scope of the present invention.

In view of the foregoing, the present invention may be summarized as a window assembly which provides a sealing member configured to fit between the opposing edge surfaces of adjacent architectural panels, compressible members for engaging the sealing member serrations and the opposite edge surfaces of each panel, and a rigid member disposed in an interior cavity portion of the sealing member and of such straightness to align the sealing member with the opposing edge surfaces of the adjacent panels.

The flanged base of the sealing member prevents external forces normally encountered by window assemblies from displacing the crown of the seal assembly outward relative to the exterior surfaces of the panels being joined. The spine, held at top and bottom by horizontal gaskets and backed up by the vertical mullion vertical face, moves inward in relation to the face of the panels only a minimum allowable amount corresponding to maximum designed wind loads. Because of the spine's tapered shape, it can freely move to leave the cavity of the sealing member. The crown of the sealing member which is held to opposed edge surfaces of the glass panels by a soft mastic sealant remains flush with the exterior surfaces of the panels.

It will be apparent to those skilled in the art that modifications and variations can be made in the joint seal assembly of this invention. The invention in its broader aspects is, therefore, not limited to the specific details, representative apparatus, and illustrative examples shown and described herein above. Thus, it is intended that all matter contained in the foregoing description or shown in the accompanying drawings shall be interpreted as illustrative and not in a limiting sense.

What is claimed is:

1. An architectural panel assembly having a pair of adjacent panels with spaced opposing edge surfaces of substantially equal width, each panel having opposite first and second surfaces, comprising:

a flexible and compressible sealing means configured to seal the space between the opposing edge surfaces of the two adjacent panels when the panels are in place, said sealing means having a horizontal cross section with a crown and two spaced legs, said two spaced legs each having an end opposite said crown, said crown defining an end of said sealing member opposite said leg ends, said two spaced legs forming a slotted cavity therebetween having an elongated opening opposite said crown, said opening extending the vertical length of said sealing means, the ends of said two spaced legs being flanged outwardly away from said opening, each of said flanged portions having an inner flange surface facing the crown end for abutting the first surface of one of said adjacent panels, the sealing means having a dimension measured from each of said inner flange surfaces to said crown corresponding to the width of said adjacent panels to be sealed, for limiting the crown of the sealing member to a position flush with the second surface of each of the adjacent panels, no portion of said sealing means extending beyond the second surface of the adjacent panels;

a rigid member configured to fit in the cavity portion of said sealing means to maintain said sealing means in alignment with the opposing edge surface of said adjacent panels for positioning the crown flush with said second surface of each of the adjacent panels for the entire length of the rigid member, whereby said sealing means and said rigid member are configured for complete sealing installation from the first surface side of said adjacent panels.

2. A joint seal assembly as recited in claim 1, further comprising means in physical engagement with said rigid member for holding said rigid member within said cavity of said sealing means.

3. The joint seal assembly as recited in claim 2, wherein said sealing means includes a flexible sealing member having outer surface serrations, and compressible members for engaging said sealing member serrations and the opposite edge surfaces of each of said adjacent panels.

4. A joint seal assembly as recited in claim 3, wherein said compressible members comprise a first and a second strip of soft mastic sealant fixed to the outer surface serrations of said sealing member, said first and second sealant strips facing respective adjacent edge surfaces of said two adjacent panels.

5. The joint seal assembly as recited in claim 4, wherein said first and second strips of soft mastic sealant are comprised of butyl.

6. The joint seal assembly as recited in claim 3, wherein said compressible members comprise a first and a second strip of soft mastic sealant respectively fixed to the opposing edge surfaces of said two adjacent panels, said strips sealingly engaging said sealing member.

7. The joint seal assembly as recited in claim 6, wherein said first and second strips of soft mastic sealant are comprised of butyl.

8. An architectural panel assembly having a pair of adjacent panels with spaced opposing substantially parallel edge surfaces of substantially equal width, each panel having opposite first and second surfaces, comprising:

a plastic sealing member for sealing the vertical length of the opposing edge surfaces of the adjacent panels being joined, said sealing member having a horizontal cross section with a crown and two spaced legs having outer surface serrations extending therefrom, said two spaced legs each having an end opposite said crown, said crown defining an end of said sealing member opposite said leg ends, said two spaced legs forming a slotted cavity therebetween having an elongated opening opposite said crown, said opening extending the vertical length of said sealing member, the ends of said two spaced legs being flanged outwardly away from said opening, each of said flanged portions having an inner flange surface facing the crown end, for abutting the first surface of one of said adjacent panels, the sealing member having a dimension measured from each of said inner flange surfaces to said crown corresponding to the width of said adjacent panels to be sealed, for limiting the crown of the sealing member to a position flush with the second surface of each of the adjacent panels, no portion of said sealing means extending beyond the second surface of the adjacent panels;

a rigid member configured to fit in the slotted cavity portion of said plastic sealing member to maintain said sealing member in alignment with the opposing edge surfaces of the adjacent panels for positioning the crown flush with said second surface of the adjacent panels for the entire length of the rigid member, whereby said plastic sealing member and said rigid member are configured for complete sealing installation from the first surface side of said adjacent panels;

compressible means for engaging said sealing member outer surface serrations and the opposite edge surfaces of the adjacent panels, said engaged outer surface serrations being intermediate said crown and said inner flange surfaces; and means in physical engagement with said rigid member for holding said rigid member within said slotted cavity of said sealing member.

9. The joint seal assembly as recited in claim 8, wherein said rigid member is a spine comprised of aluminum material.

10. The joint seal assembly as recited in claim 9, wherein said spine has a T-shaped horizontal cross section, said T-shape providing the rigidity for holding said sealing member in straight alignment with the opposing edges of said two adjacent panels.

11. The joint seal assembly as recited in claim 10, wherein said cavity is tapered, and wherein the T-shaped horizontal cross section of the spine includes an extended portion and an integral cross portion, said extended portion being dimensioned and tapered to conform to the taper of the cavity.

12. The joint seal assembly as recited in claim 11, wherein the extended portion of said metal spine is of such dimension that when positioned and fitted in the cavity, the spine extends inwardly from the interior surface of the two adjacent panels to position the cross portion a predetermined distance therefrom.

13. The joint seal assembly as recited in claim 12, wherein said extended portion is dimensioned such that when it is fully inserted in said cavity, the upper and lower portions of said extended portion have a depth substantially corresponding to the depth of the cavity, and wherein said rigid member holding means includes a gasket member substantially covering the upper and lower portions of the extended portion of the rigid member in the cavity of the sealing member.

14. The joint seal assembly as recited in claim 13, wherein the width of said crown is slightly greater than the width of said sealing member proximate said outer surface serrations.

15. An architectural panel assembly having a pair of adjacent panels with spaced opposing substantially parallel edge surfaces of substantially equal width, each panel having opposite first and second surfaces, said assembly comprising:

a vertical support mullion adjacent to the first surface of each of said adjacent panels;

means for adhering the first surface of said panels to said vertical support mullion;

lower track means for supporting each of said panels at its bottom edge portion, and upper track means for supporting each of said architectural panels at its top edge portion;

a flexible and compressible sealing member configured to seal the space between the opposing edge surfaces of the two adjacent panels supported by said mullion and said track means, said sealing member having a horizontal cross section with a crown and two spaced legs, said two spaced legs each having an end opposite said crown, said crown defining an end of said sealing member opposite said leg ends, said two spaced legs forming a slotted cavity therebetween having an elongated opening opposite said crown, said opening extending the vertical length of said sealing member, the ends of said two spaced legs being flanged outwardly away from said opening, each of said flanged portions having an inner flanged surface facing the crown end for abutting the first surface of one of said adjacent panels, the sealing member having a dimension measured from each of said inner flanged surfaces to said crown corresponding to the width of said adjacent panels to be sealed, for limiting the crown of the sealing member to a position flush with the second surface of each of the adjacent panels, no portion of said sealing means extending beyond the second surface of the adjacent panels;

a straight rigid member configured to fit in the cavity portion of said sealing member, said rigid member being in straight alignment with the opposing edge surfaces of said adjacent panels for positioning the crown flush with said second surface of each of the adjacent panels for the entire length of the rigid member; and means attached to said upper and lower track means cooperating to hold said rigid member in the cavity of said sealing member.

16. The assembly as recited in claim 15, wherein adhering means comprise silicone strips applied between the vertical support mullion and the interior surface of each of said two adjoining adjacent panels.

17. The assembly as recited in claim 16, wherein adhering means further comprise double face tape strips applied between the vertical support mullion and the interior surface of each of said two adjacent panels.

18. The assembly as recited in claim 15, wherein said vertical support mullion has a vertical face positioned inwardly of the rigid member, said mullion vertical face extending substantially the vertical length of said sealing member and located a distance from the rigid member that is less than the widths of the two adjacent panels being joined.

* * * * *